United States Patent [19]

Hoff

[11] Patent Number: 5,054,849

[45] Date of Patent: Oct. 8, 1991

[54] ULTRA-PORTABLE COLLAPSIBLE CHAIR

[76] Inventor: Richard Hoff, 1187 Delaware St., Berkeley, Calif. 94702

[21] Appl. No.: 566,268

[22] Filed: Aug. 13, 1990

[51] Int. Cl.[5] ..... A47C 4/28

[52] U.S. Cl. ..... 297/45; 297/441

[58] Field of Search ..... 297/16, 45, 441, 42

[56] References Cited

U.S. PATENT DOCUMENTS

| | | | |
|---|---|---|---|
| 2,691,410 | 10/1954 | Boucher | 297/441 X |
| 2,722,972 | 11/1955 | Altruda | 297/441 X |
| 3,124,387 | 3/1964 | MacLaren | 297/45 X |
| 4,148,520 | 4/1979 | Miller | 297/441 X |
| 4,421,356 | 12/1983 | Singer | 297/441 X |
| 4,685,725 | 8/1987 | Helfrich | 297/45 |
| 4,717,201 | 1/1988 | Barras | 297/45 X |

*Primary Examiner*—Peter A. Aschenbrenner
*Attorney, Agent, or Firm*—Milton Gerstein

[57] ABSTRACT

A small-sized, ultra-lightweight chair that collapses into a small diameter bundle for easy storage or carrying by hand, in a bag or case, on one's back, or in a backpack, and the like. The chair comprises a front scissor-linkage and a rear scissor-linkage, which are laterally-inwardly foldable to provide for the collapsible nature of the chair. The front and rear scissor-linkages are interconnected by a crossed pair of cords, one pair connecting the scissor-linkages on one lateral side of the chair and the other X-shaped cords connecting the scissor-linkages on the other lateral side of the chair. The scissor-linkages are made of light-weight, rigid slats, the upper ends of the slats of which mount a rectangular piece of fabric for providing the seat proper upon which one sits. The lower ends of the slats of the front scissor-linkage are coupled to the lower ends of the slats of the rear scissor-linkage by a pair of folding braces, one brace for each lateral side of the chair.

16 Claims, 3 Drawing Sheets

ULTRA-PORTABLE COLLAPSIBLE CHAIR

BACKGROUND OF THE INVENTION

The present invention is directed to a portable chair that is very light in weight and collapsible into a narrow bundle like an umbrella, in order to allow it to be easily carried in a backpack, slung on one's back in a small carrying-bag, carried by hand, etc., while being easily and readily erected for immediate use for supporting a person very securely and comfortably in a sitting position. Examples of prior-art collapsible chairs are numerous. One such chair is shown in U.S. Pat. No. 3,124,387 - Maclaren. The chair disclosed in this patent, like other prior-art chairs, is collapsible by folding the chair laterally and inwardly, which is achieved by scissor-linkages in the front, rear and sides of the chair. However, this chair, like other prior-art chairs, is intrinsically heavier and more complex than the present invention, while adding nothing to the comfort of the sitter.

SUMMARY OF THE INVENTION

It is primary objective of the present invention to provide a very comfortable collapsible chair that is extremely lightweight and small in volume when folded for maximum portability, which is easy to collapse and erect, and strong enough when erected to support even a reasonably heavy person.

Toward these and other ends, the lightweight, collapsible, small-sized chair of the invention comprises a front scissor-linkage and a rear scissor-linkage, which are laterally-inwardly foldable to provide for the collapsible nature of the chair. The front and rear scissor-linkages are interconnected by a pair of cords forming an X-shaped configuration, one pair connecting the scissor-linkages on lateral side of the chair and the other pair connecting the scissor-linkages on the other side of the chair. These cords function as braces. The scissor-linkages are made of light-weight, wooden slats, the upper ends of which mount a rectangular piece of fabric or netting for providing the sling seat proper upon which one sits. The lower ends of the slats of the front scissor-linkage are coupled to the lower ends of the slats of the rear scissor-linkage by a pair of braces, one brace for each side of the chair, whereby the chair is given structural integrity. The front and rear scissor-linkages incline outward, away from each other, at their upper ends, in order to avoid inward collapse and to ensure the support of a person sitting thereon in a safe and stable manner. In the preferred embodiment, each lower brace is comprised of two pivotal sections which fold upon each other when the chair is collapsed in the fore-and-aft directions, in order to add nothing to the length of the chair when folded. This chair is free-standing and securely braced in the fore-and-aft directions when a person is seated thereon.

In an alternative embodiment, to make the chair simpler and even more lightweight, the lateral cord braces are eliminated and each of the pair of lower braces is made of one piece, is not foldable upon itself, and is of a length such that the lower ends of the chair when erected are spaced much closer together than the upper ends of the chair in which the sitter must keep his or her own balance, whereby there is a provided a non-free-standing chair, that is only erectable by the actual sitting therein of a person.

BRIEF DESCRIPTION OF THE DRAWING

The invention will be more readily understood with reference to the accompanying drawing, wherein.

DETAILED DESCRIPTION OF THE INVENTION

Figure 1:
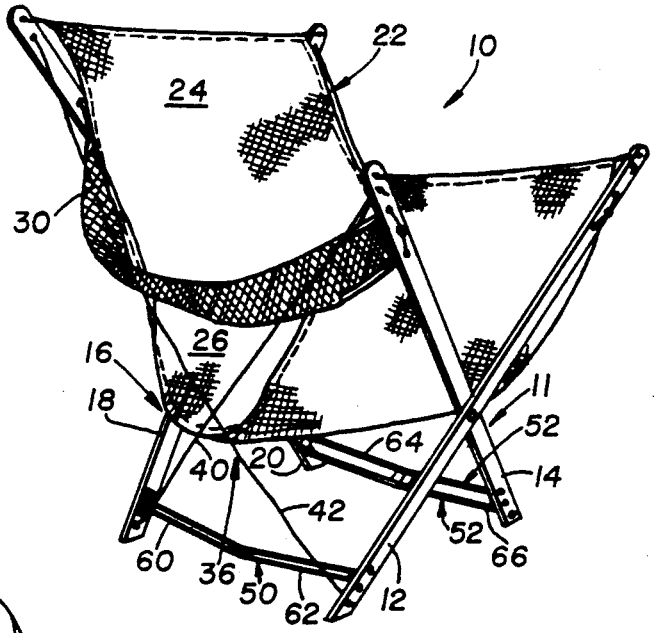
FIG. 1 is an isometric view of the collapsible chair according to a first embodiment of the invention, shown in its erected state.
Figure 2:
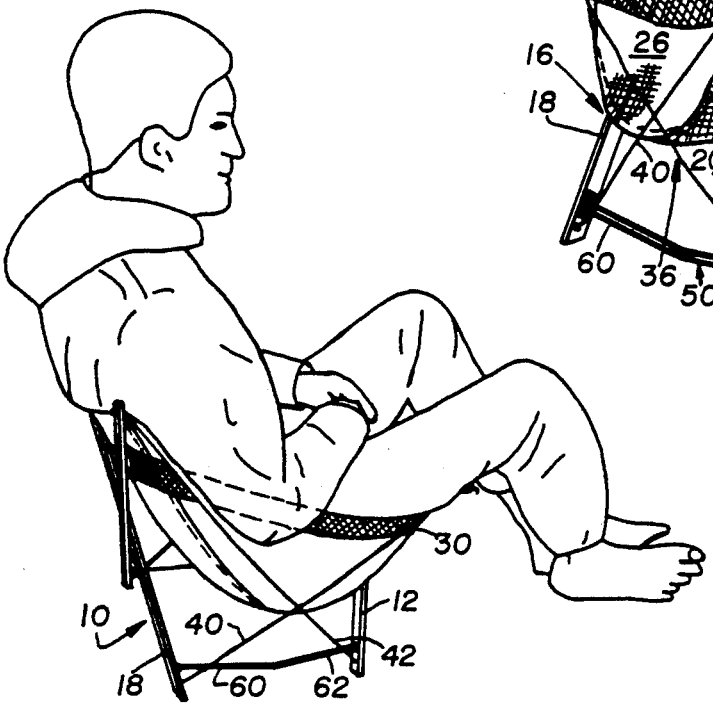
FIG. 2 is an isometric view thereof with a person seated thereon.
Figure 3:
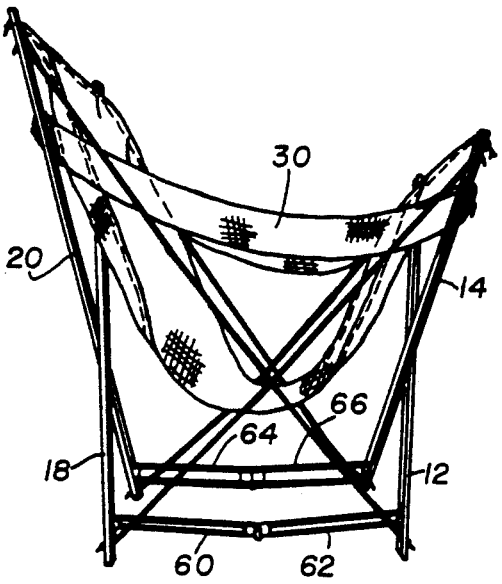
FIG. 3 is a side view thereof.
Figure 4:
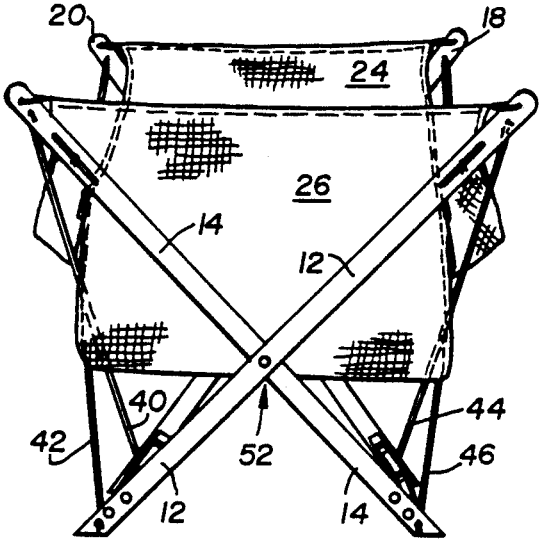
FIG. 4 is a front view thereof.
Figure 5:
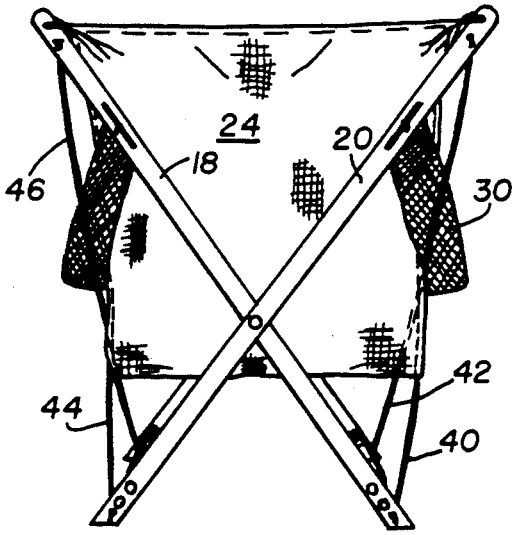
FIG. 5 is a rear view thereof.
Figure 6:
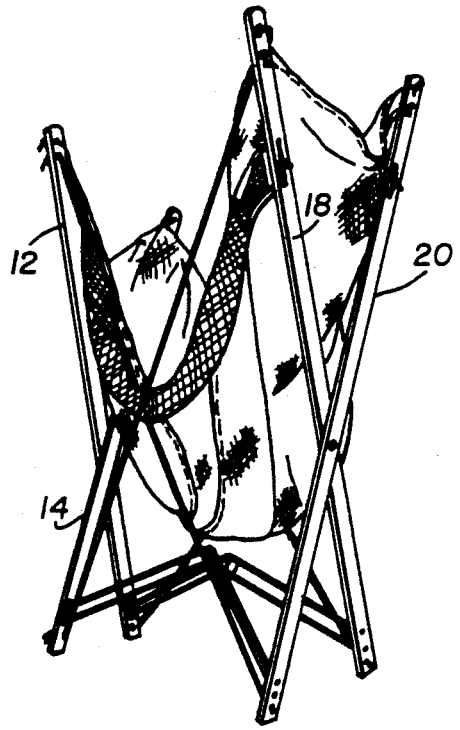
FIG. 6 is an isometric view thereof showing the chair in its partially collapsed state.
Figure 7:
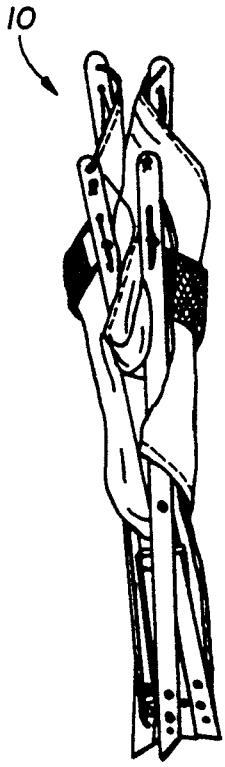
FIG. 7 is an isometric view thereof showing the chair in its fully collapsed state.

Referring now to the drawings in greater detail, the lightweight, collapsible chair of the invention is indicated generally by reference numeral 10. The embodiment shown in FIGS. 1–10 is designed to be a free-standing unit. Although the chair 10 is free-standing, it is not very stable until a person sits therein, as set forth below, this deriving from the fact that fore-and-aft stability is secured by flexible cords rather than rigid braces, in order to minimize weight, bulk, and mechanical complexity. The chair 10 has a front scissor-linkage 11 made of a pair of pivoted, crossing elongated members 12, 14, and a rear scissor-linkage 16 made of a pair of pivoted, crossing elongated members 18, 20. Each scissor-linkage is collapsible by pivoting the respective elongated members thereof toward each other, as shown in FIGS. 6 and 7. These scissor-linkages are also movable toward and away from each other in the fore-and-aft directions for collapsing and erecting the chair, respectively, as shown in FIGS. 6 and 7. Each elongated member may be made of wood, aluminum, and the like. A seat proper 22 is also shown defining a back-rest portion 24 and a seat portion 26. The upper or rear end portion of the back-rest portion is tied, or otherwise secured, to the upper end portions of the rear scissor-linkage members 18, 20, while the forward or upper end portion of the seat portion 26 is tied, or otherwise secured, to the upper end portions of the front scissor-linkage members 12, 14. Thus, the seat proper 22 is U-shaped to support a person thereon in a comfortable and secure manner, as seen in FIG. 2. Webbing braces 30, 32 are also provided, each brace being secured between upper portions of oppositely-disposed elongated members 12, 18 or 14, 20, respectively. A pair of lateral cross-braces 36, 38 forming an X-shaped configuration are provided, each cross-brace being made of strong flexible cords, such as nylon, or similar material. The frame 36 has cords 40, 42 and the frame 38 has cords 44, 46. Each cord 40-46 has an upper end tied, or otherwise secured, to an upper end portion of one elongated member of one of the front and rear scissor-linkages, and a lower end tied, or otherwise secured, to a lower end portion of an elongated member of the other of the front and rear scissor-linkages on the same side. The length of each cord 40-46 is such that when the chair is erected, with the rear and front scissor-linkages pivoted open and drawn away from each other, and a person sitting therein, the cords are made taut, with the upper end portions of the elongated members of the front and rear scissor-linkages spaced somewhat farther apart fore-and-aft than the lower end portions thereof, so that, with a person sitting in the chair and on the seat proper, the chair will not collapse in on itself, which might otherwise occur due to the inward pull on the upper end portions of the elongated members of the front and rear scissor-linkages caused by the downward pull of the person's weight on the seat portion 26.

To ensure that the lower ends of the scissor-linkages do not tend to slide toward each other when the chair is erected, and to define and preserve the proper degree of tension in the lateral cord braces, there are also provided a pair of lower spacer or brace elements 50, 52, one on each lateral side of the chair. The spacer element 50 is pivotally connected at its first front end to the lower end of the elongated member 12 and at its second rear end to the lower end of the elongated member 18. The spacer element 52 is pivotally connected at its first forward end to the lower end of the elongated member 14, and at its second rear end to the lower end of the elongated member 20. The lateral cords are the shortest length possible to connect the ends of the scissor-linkages in the folded position. The length of each spacer brace 50,52 is then determined by erecting the chair and seeing how far apart the feet of the chair must be maintained so that when one sits in the chair, the cord braces will become properly taut. This relationship between the length of the cords and the length of the spacer braces is such that the feet remain just close enough together so that just enough outward inclination of the scissor-linkages remains to enable the erected and unoccupied chair to barely stand by itself. The cords can be no shorter than the minimal length which allows the chair to fold the spacing of the feet is determined by the length of the cords; and the degree of outward lean is determined by the spacing of the feet.

Figure 8:
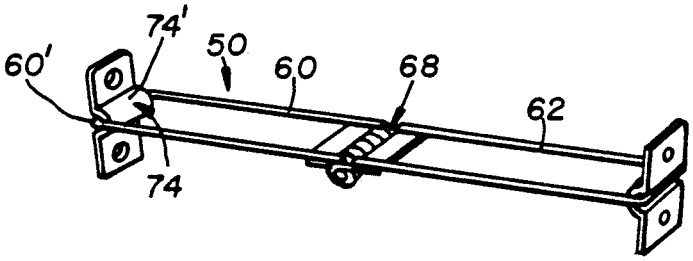
FIG. 8 is an isometric view of one of the pair of lower foldable braces in its unfolded, erected state.
Figure 9:
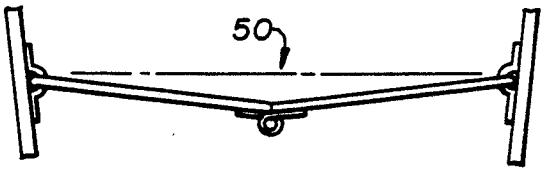
FIG. 9 is a side view of the brace in its fully-erected thereof.
Figure 10:
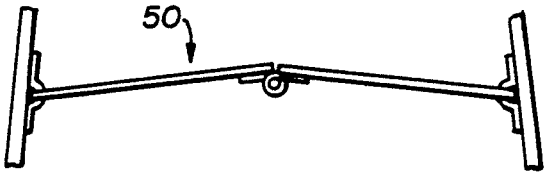
FIG. 10 is a side view of the brace in a partially-collapsed state.

Each of the spacer or brace elements 50, 52, in the preferred embodiment, is comprised of two loop-sections 60, 62 or 64, 66, respectively, with the two loop-sections being pivotally connected to each other to allow for the folding in thereof, as shown in FIGS. 6-8. Hinge-mounts 68, 68 provide the hinged coupling for these loop-sections, with the loop-sections being folded by pivoting them downwardly with respect to the respective hinge-mounts. The loop-sections of each respective spacer element folds upon itself by pivoting the loop-sections downwardly, as seen in FIGS. 6 and 10. The erected, opened state of each spacer element, as seen in FIG. 9, is achieved when the pivoted interior ends of the respectively pivoted loop-sections abut each other, as shown In FIG. 9, whereby the limit to the pivoted opening of the spacer element is provided.

The distal end of each loop-sections is pivotally coupled to an inwardly-facing lower surface of a respective elongated member via pivot-brackets 74, best seen in FIGS. 6 and 8. Each pivot-bracket 74 defines a hemispherical-shaped sleeve 74' through which is freely passed an end of the respective loop section, such as end 60 of the loop-section 60. Thus, each loop-section is also pivotally connected to a lower interior portion of an elongated member. The loop-section 60 is pivoted to the lower end portion of the member 18, while the loop-section 62 is pivoted to the lower end portion of the member 12. Similarly, the loop-section 64 is pivoted to the lower end portion of the member 20, and the loop-section 66 is pivoted to the lower end portion of the member 14. This pivotal coupling allows each spacer element to be easily and readily folded upon itself, when the chair is collapsed.

In the preferred embodiment, the length of each rear elongated member 18, 20 is greater than that of each forward elongated member 12, 14 in order to provide the back-rest portion above-described. However, it is within the scope and purview of the invention to provide that all of these elongated members are of the same length.

Figure 11:
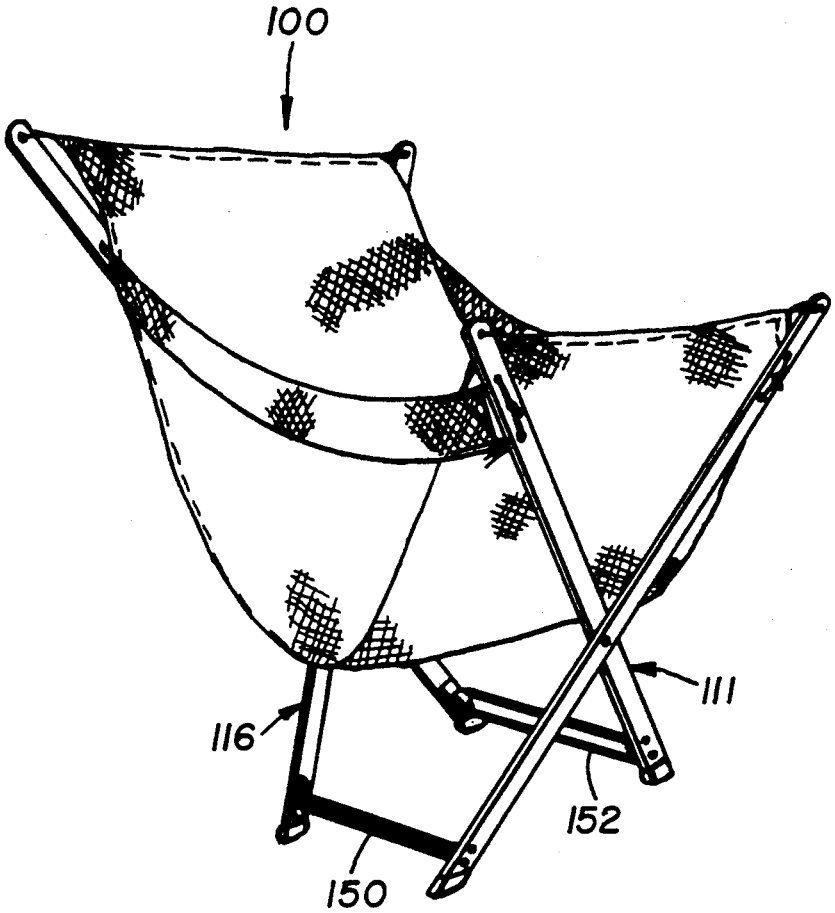
FIG. 11 is an isometric view showing a second embodiment of the invention with unfoldable lower braces, which second embodiment is not free-standing.

A modification of the chair of the invention is shown in FIG. 11, and is indicated generally by reference numeral 100. The chair 100 is similar in most respects to the chair 10 of the preferred embodiment, with the following notable differences: The chair !00 does not have the lateral cross-braces, and the lower spacer or brace elements 150, 152 are not foldable upon themselves. Each spacer element is one loop-shaped element, similar to an individual loop-section of the spacer elements of the chair 10, with each end being pivotally coupled to a lower portion of the elongated members of the scissor-linkages in the manner described above for the chair 10. In addition, the length of each spacer element 150,152 is much less than the combined lengths of the two individual loop-sections of the spacer elements 50, 52 of the chair 10, so that the lower end portions of the front scissor-linkage 111 of the chair 100 is spaced proportionately closer to the lower end portions of the rear scissor-linkage 116. This configuration allows sufficient space to accommodate the sitter's body, while determining that, when the chair is folded, the length of the front scissor-linkage plus the length of the spacer members equals the length of the rear scissor-linkage. Chair 100 is not free-standing; that is, when opened up, and placed on the ground, and without a person sitting thereon, the chair 100 will not stand by itself; nor will it prevent the sitter from falling forward or backward, although it is easy to keep one's own balance once seated. This offers the advantage of a simpler, sturdier, less expensive chair, which is also of lighter weight as compared with the chair 10. A person who wishes to sit on the chair 100 first places the chair on the ground or other supporting surface, and as he crouches down to sit thereon, holds on to the chair to keep it erect, until he is firmly seated thereon, after which, he may release his hold on the chair, with the chair now being retained in its erected state via the weight of the person seated thereon. The chair 100 weighs about twenty ounces, and when collapsed, occupies a volume of less than three inches in diameter, with a length of only 23 inches, which is the length of each of the elongated slats or members of the rear scissor-linkage. The chair 10 is only slightly heavier and also collapses to approximately the same dimensions above-mentioned. Either the chair 10 or 100 may be readily stored in a small-diameter case or bag to keep it collapsed and for allowing easy transport thereby.

While a specific embodiment of the invention has been shown and described, it is to be understood that numerous changes and modifications may be made therein without departing from the scope, spirit and intent of the invention as set forth in the appended claims.

What I claim is:

1. In a collapsible chair comprising a rear, foldable scissor-linkage; a front foldable scissor-linkage, each of said scissor-linkages having a pair of elongated members pivoted together at a mid-section of each said elongated member, each said elongated member of each said scissor-linkage having a lower end-portion and an upper end-portion; and a seat proper having a rearward end-section secured to said rear scissor-linkage, and a forward end-section secured to said front scissor-linkage, said seat proper being made of flexible material to allow for the folding-in thereof, and a pair of armrest brace elements, wherein the improvement comprises:

a first, lower spacer-element and a second lower spacer-element, said spacer-elements being spaced apart in the lateral, widthwise direction;

said first spacer-element having a first, forward end-portion and a second, rear end-portion, said first, forward end-portion thereof being pivotally coupled to said lower end-portion of one said elongated member of said front scissor-linkage, and said second, rear end-portion thereof being pivotally coupled to said lower end-portion of one said elongated member of said rear scissor-linkage, said lower end-portions of said one elongated members of said front and rear scissor-linkages being substantially on the same lateral side;

said second spacer-element having a first, forward end-portion and a second, rear end-portion, said first, forward end-portion thereof being pivotally coupled to said lower end-portion of the other of said elongated member of said front scissor-linkage, and said second rear end-portion thereof being pivotally coupled to said lower end-portion of the other of said elongated member of said rear scissor-linkage, said lower end-portions of said other elongated members of said front and rear scissor-linkages being substantially on the same lateral side but different from the lateral side of said lower end-portions of said one elongated members;

each said spacer-element having a length so as to space said lower end-portions of said front and rear scissor-linkages a predetermined horizontal distance apart when the chair is erected, said horizontal predetermined distance apart being less than the horizontal distance between said upper endportions of said front scissor-linkage and said upper end portions of said rear scissor-linkage, whereby said front scissor-linkage, when the chair is erected, slopes upwardly and forwardly away from said rear scissor-linkage, whereby the chair is made lightweight and still capable of supporting a person seated thereon; and pivot-mounting means for pivotally mounting each said end of each said spacer-element to a respective said lower end portion of said elongated members, whereby said spacer-elements may be pivoted relative to said scissor-linkages to allow for the collapsing of the chair by moving said front and rear scissor-linkages toward each other.

2. The chair according to claim 1, wherein each said elongated member of said front scissor-linkage is disconnected from a corresponding said elongated member of said rear scissor-linkage along the length thereof between said lower end thereof and the portion thereof connected to said seat proper, and the length thereof between said seat proper and the uppermost end thereof, whereby said front scissor-linkage may easily assume said forward-sloping state thereof.

3. The chair according to claim 1, wherein each said spacer-element comprises a closed, hollow loop-member, said pivot-mounting means comprising a plurality of bracket-mounts, one said bracket-mount for one said lower end, each said bracket-mount receiving therethrough an end of a respective said loop-member.

4. The chair according to claim 3, wherein each said loop-member is made of a rigid, straight metal link.

5. The chair according to claim 3, wherein each said elongated member is made of lightweight, rigid material.

6. The chair according to claim 1, further comprising a pair of X-shaped lateral ties, each said X-shaped tie comprising a pair of flexible cord-members, each cord-member having an upper end and a lower end; said upper end of one said cord-member being coupled to the upper end of one said elongated member of said front scissor-linkage, and said lower end of said one cord-member being coupled to the lower end-portion of one elongated member of said rear scissor-linkage on the same lateral side as said upper end of said one elongated member to which is coupled said upper end of said one cord-member; said upper end of the other cord-member of each said X-shaped tie being coupled to the upper end of the other elongated member of said rear scissor-linkage, and said lower end of said other cord-member being coupled to the lower end of the other elongated member of said front scissor-linkage; each said cord having a length such that as to prevent either fore-and-aft motion when a person is seated in the chair, said rear scissor-linkage sloping rearwardly and upwardly away from said front scissor-linkage.

7. The chair according to claim 6, wherein each said cord-member is made at least partially of nylon fabric.

8. The chair according to claim 6, wherein each said spacer element comprises a first, rearward link-member and a second, forward link-member coupled to said first link-member, and means for pivotally mounting said first and second linkmembers together, whereby said link-members of each said spacer-element fold upon themselves when the chair is collapsed by moving said front and rear scissor-linkages toward each other.

9. The chair according to claim 8, wherein said pivot-mounting means comprises a plurality of bracket-mounts, one said bracket-mount for one said lower end, each said bracket-mount receiving therethrough an end of a respective said link-member.

10. The chair according to claim 8, wherein each of said first and second link-members comprises a rearward end and a forward end, said means for pivotally mounting said first and second link-members together comprises a hinge-member pivotally connecting said forward end of said first link-member to said rearward end of said second link-member.

11. The chair according to claim 8, further comprising a pair of X-shaped lateral ties, each said X-shaped tie comprising a pair of flexible cord-members, each said cord-member having an upper end and a lower end; said upper end of one said cord-member being coupled to the upper end of one said elongated member of said front scissor-linkage, and the lower end of said one cord-member being coupled to the lower end-portion of one elongated member of said rear scissor-linkage on the same lateral side as said upper end of said one elongated member to which is coupled said upper end of said one cordmember; said upper end of the other cord-member of each said X-shaped tie being coupled to the upper end of the other elongated member of said rear scissor-linkage, and said lower end of said other cord-member being coupled to the lower end of the other elongated member of said front scissor-linkage; each said cord having a length such that as to prevent either fore-and-aft motion when a person is seated in the chair.

12. The chair according to claim 11, wherein each said cord-member is made at least partially of nylon fabric.

13. The chair according to claim 1, wherein the length of each said elongated member of said rear scissor-linkage is greater than the length of each said elongated member of said front scissor-linkage; said forward end-section of said seat proper being connected said upper end portions of said elongated member of said front scissor-linkage, and said rearward end-section of said seat proper being connected to said upper end-portions of said elongated members of said rear scissor-linkage.

14. The chair according to claim 11, wherein the length of each said elongated member of said rear scissor-linkage is greater than the length of each said elongated member of said front scissor-linkage; said forward end-section of said seat proper being connected said upper end portions of said elongated member of said front scissor-linkage, and said rearward end-section of said seat proper being connected to said upper end-portions of said elongated members of said rear scissor-linkage.

15. A method of using a very lightweight, collapsible chair, which chair comprises a rear, foldable scissor-linkage; a front foldable scissor-linkage, each of said scissor-linkages having a pair of elongated members pivoted together at a mid-section of each said elongated member, each said elongated member of each said scissor-linkage having a lower end-portion and an upper end-portion; and a seat proper having a rearward end-section secured to said rear scissor-linkage, and a forward end-section secured to said front scissor-linkage, and a pair of armrest brace elements, said seat proper being made of flexible material to allow for the folding-in thereof, a first, lower spacer-element and a second lower spacer-element, said spacer-elements being spaced apart in the lateral, widthwise direction;

said first spacer-element having a first, forward end-portion and a second, rear end-portion, said first, forward end-portion thereof being pivotally coupled to said lower end-portion of one said elongated member of said front scissor-linkage, and said second, rear end-portion thereof being pivotally coupled to said lower end-portion of one said elongated member of said rear scissor-linkage, said lower end-portions of said one elongated members of said front and rear scissor-linkages being substantially on the same lateral side;

said second spacer-element having a first, forward end-portion and a second, rear end-portion, said first, forward end-portion thereof being pivotally coupled to said lower end-portion of the other of said elongated member of said front scissor-linkage, and said second rear end-portion thereof being pivotally coupled to said lower end-portion of the other of said elongated member of said rear scissor-linkage, said lower end-portions of said other elongated members of said front and rear scissor-linkages being substantially on the same lateral side but different from the lateral side of said lower end-portions of said one elongated members;

each said spacer-element having a length so as to space said lower end-portions of said front and rear scissor-linkages a predetermined horizontal distance apart when the chair is erected, said horizontal predetermined distance apart being less than the horizontal distance between said upper end-portions of said front scissor-linkage and said upper end portions of said rear scissor-linkage, whereby said front scissor-linkage, when the chair is erected, slopes upwardly and forwardly away from said rear scissor-linkage, whereby the chair is made lightweight and still capable of supporting a person seated thereon; and pivot-mounting means for pivotally mounting each said end of each said spacer-element to a respective said lower end portion of said elongated members, whereby said spacer-elements may be pivoted relative to said scissor-linkages to allow for the collapsing of the chair by moving said front and rear scissor-linkages toward each other;

a pair of X-shaped lateral ties, each said X-shaped tie comprising a pair of fabric-cord members, each cord-member having an upper end and a lower end; said upper end of one said cord-member being coupled to the upper end of one said elongated member of said front scissor-linkage, and the said lower end of said one cord-member being coupled to the lower end-portion of one elongated member of said rear scissor-linkage on the same lateral side as said upper end of said one elongated member to which is coupled said upper end of said one cord-member; said upper end of the other cord-member of each said X-shaped tie being coupled to upper end of the other elongated member of said rear scissor-linkage, and said lower end of said other cord-member being coupled to the lower end of the other elongated member of said front scissor-linkage; each said cord having a length such that as to prevent said front scissor-linkage from assuming a fully-upright, vertical orientation when the chair is in its fully-erected state, said method comprising:

a) pivoting said rear and front scissor-linkages into their open states;

b) drawing said front scissor-linkage and said rear scissor-linkage away from each other;

c) said step (b) comprising drawing each said cord-member into a taut state thereof;

(d) said step (b) inherently spacing the lower end portions of said elongated members of said front scissor-linkage horizontally closer to the lower end portions of said rear scissor-linkage than the horizontal spacing of the upper end portions of said front scissor-linkage from the upper end portions of said rear scissor-linkage in order to prevent the chair from falling in when sat upon;

(e) said step (d) being carried out by means of said spacer elements, said cord-members and said armrest brace elements.

16. A method of making a very lightweight, collapsible chair, which chair comprises a rear, foldable scissor-linkage; a front foldable scissor-linkage, each of said scissor-linkages having a pair of elongated members pivoted together at a mid-section of each said elongated member, each said elongated member of each said scissor-linkage having a lower end-portion and an upper end-portion; and a seat proper having a rearward end-section secured to said rear scissor-linkage, and a forward end-section secured to said front scissor-linkage, said seat proper being made of flexible material to allow for the folding-in thereof, a first, lower spacer-element and a second lower spacer-element, said spacer-elements being spaced apart in the lateral, widthwise direction, and a pair of X-shaped lateral ties, each said X-shaped tie comprising a pair of fabric-cord members, each cord-member having an upper end and a lower end; said upper end of one said cord-member being coupled to the upper end of one said elongated member of said front scissor-linkage, and the said lower end of said one cord-member being coupled to the lower end-portion of one elongated member of said rear scissor-linkage on the same lateral side as said upper end of said one elongated member to which is coupled said upper end of said one cord-member; said upper end of the other cord-member of each said X-shaped tie being coupled to upper end of the other elongated member of said rear scissor-linkage, and said lower end of said other cord-member being coupled to the lower end of the other elongated member of said front scissor-linkage; each said cord having a length such that as to prevent said front scissor-linkage from assuming a fully-upright, vertical orientation when the chair is in its fully-erected state, said first spacer-element having a first, forward end-portion and a second, rear end-portion, said first, forward end-portion thereof being pivotally coupled to said lower end-portion of one said elongated member of said front scissor-linkage, and said second, rear end-portion thereof being pivotally coupled to said lower end-portion of one said elongated member of said rear scissor-linkage, said lower end-portions of said one elongated members of said front and rear scissor-linkages being substantially on the same lateral side;

said second spacer-element having a first, forward end-portion and a second, rear end-portion, said first, forward end-portion thereof being pivotally coupled to said lower end-portion of the other of said elongated member of said front scissor-linkage, and said second rear end-portion thereof being pivotally coupled to said lower end-portion of the other of said elongated member of said rear scissor-linkage, said lower end-portions of said other elongated members of said front and rear scissor-linkages being substantially on the same lateral side but different from the lateral side of said lower end-portions of said one elongated members; said method comprising:

a) connecting each said cord to a respective said end portion of a respective said elongated member;

b) said step (a) being performed when said front and rear scissor-linkages are in their folded state and in close juxtaposition to each other, which juxtaposition constitutes the folded collapsed state of the chair;

c) said step (a) further comprising stretching each said cord between the respective end portions to which it is connected until said cord is made taut;

d) thereafter, unfolding the scissor-linkages and opening the chair by moving the scissor-linkages away from each other a distance where each said cord is stretched taut between its respective connections to end portions of the elongated member;

e) thereafter, pivotally connecting the ends of each said spacer element to the respective said lower end portion of a respective said elongated member when said scissor-linkages and said cords are in the state assumed by said (d).

* * * * *